US006401593B1

(12) United States Patent
Weberruss

(10) Patent No.: US 6,401,593 B1
(45) Date of Patent: Jun. 11, 2002

(54) DRIVE AND GUIDE MEANS FOR A LOAD TO BE MOVED

(75) Inventor: Rolf Weberruss, Kernen (DE)

(73) Assignees: Festo AG & Co., Esslingen; Dowaldwerke Adolph Dowald GmbH & Co., KG, Bremen, both of (DE)

( * ) Notice: Subject to any disclaimer, the term of this patent is extended or adjusted under 35 U.S.C. 154(b) by 0 days.

(21) Appl. No.: 09/388,713

(22) Filed: Sep. 2, 1999

(30) Foreign Application Priority Data

Sep. 17, 1998 (DE) ..... 198 42 594

(51) Int. Cl.[7] ..... F01B 29/00
(52) U.S. Cl. ..... 92/88; 92/126; 92/178
(58) Field of Search ..... 92/88, 137, 126, 92/178

(56) References Cited

U.S. PATENT DOCUMENTS 3,466,054 A * 9/1969 Berg ..... 92/178 X
4,704,949 A * 11/1987 Foster ..... 92/178 X
4,813,341 A * 3/1989 Vaughn ..... 92/88
4,852,465 A * 8/1989 Rosengren ..... 92/88

FOREIGN PATENT DOCUMENTS

| | | | |
|---|---|---|---|
| DE | GM 1 982 379 | | 3/1968 |
| DE | 43 32 547 A1 | | 3/1995 |
| EP | 0645544 B1 | | 3/1995 |
| GB | 2107822 | * | 5/1983 |

* cited by examiner

*Primary Examiner*—Hoang Nguyen
(74) *Attorney, Agent, or Firm*—Hoffman & Baron, LLP

(57) ABSTRACT

A drive and guide means for a load to be moved which comprises a rodless drive piston adapted to be driven by a pressure medium in a pressure medium cylinder, such piston having at least one force transmission part extending outward through a longitudinal slot in a wall of such cylinder. A flexible sealing tape for seals off the longitudinal slot on either side of the force transmission part. An anti-friction bearing arrangement serves to take up a load and/or to guide the piston, such anti-friction bearing arrangement being arranged in the housing of the pressure medium cylinder. An anti-friction bearing arrangement is arranged within the cylinder space of the pressure medium cylinder in or on the drive piston. This means that pressure medium cylinders with an extremely small cross section and an extremely simple structure may be produced economically.

15 Claims, 5 Drawing Sheets

DRIVE AND GUIDE MEANS FOR A LOAD TO BE MOVED

BACKGROUND OF THE INVENTION

The invention relates to a drive and guide means for a load to be moved comprising a pressure medium cylinder, a rodless drive piston adapted to be driven by a pressure medium in such pressure medium cylinder, at least one force transmission part extending outward through a longitudinal slot in a wall of such cylinder, a flexible sealing tape for sealing off the longitudinal slot on either axial side of the force transmission part and an anti-friction bearing arrangement serving to take up a load and/or to guide the piston, such anti-friction bearing arrangement being arranged in the housing of the pressure medium cylinder.

THE PRIOR ART.

In the case of a known drive and guide means of this type disclosed in the German patent publication 4,332,547 A1 a load supporting anti-friction bearing arrangement is arranged in a longitudinal channel, provided in the housing of a pressure medium cylinder, extending in parallelism to the cylinder bore of such pressure medium cylinder. Owing to such parallel arrangement of the drive piston and the anti-friction bearing arrangement the housing of the pressure medium cylinder is generally extremely voluminous and it is not only necessary to have a force transmission part extending outward from the housing but also in addition a further force transmission part between the drive piston and the anti-friction bearing arrangement. This all means that entire arrangement is complicated, elaborate and expensive.

SHORT SUMMARY OF THE INVENTION

One object of the invention is accordingly to provide a drive and guide means, in the case of which the housing of the pressure medium cylinder may be designed with a smaller cross section.

A still further object of the invention is to provide such means which may be produced in a simpler, less expensive and compact form.

In order to achieve these and/or other objects appearing from the present specification, claims and drawings, in the present invention the anti-friction bearing arrangement is arranged within the cylinder space of the pressure medium cylinder in or on the drive piston.

The advantage of the arrangement of the invention is more especially that only a single longitudinal duct is provided in the housing of the pressure medium cylinder, that is to say the cylinder bore itself. This means that there is a substantially more compact form of design. Since the drive piston or, respectively, its anti-friction bearing arrangement takes up the load and as a result bears against the cylinder wall, external load or force resistant guides are now not necessary. There is accordingly no longer any danger of an external guide transmitting forces to the drive piston, which would impair its function. In fact only a single slot guide in the housing of the pressure medium cylinder is required, unlike the case of the prior art, wherein two through slots are necessary. The design of the force transmission part is accordingly substantially simplified. Moreover, the entire assembly operation becomes simpler and less expensive.

The measures recited in the claim render possible advantageous further developments and improvements in the invention.

The anti-friction bearing arrangement preferably possesses wheels or rollers and/or balls running on the cylinder bore wall.

In accordance with a first advantageous development of the invention the anti-friction bearing arrangement has an axial row of wheels or rollers inclined in opposite directions of pivot in relation to the force acting on the piston. In this respect the wheels or rollers are advantageously oppositely inclined so that the transfer of force is as even as possible.

An other advantageous feature of the invention is such that the anti-friction bearing arrangement possesses an axial row of pairs of wheels or rollers, whose axes of rotation are set perpendicularly to the direction of motion of the drive piston and perpendicularly to the direction of the force acting on the piston.

The anti-friction bearing bodies of the bearing arrangement are rotatably placed in corresponding recesses in the drive piston or a bearing arrangement connected with it and extend out from the recesses at those points, at which the drive piston bears against the cylinder bore wall. This means that there is an excellent transfer of force by a relatively small number of anti-friction bearing bodies.

To stabilize the position of the piston and to resist pivoting moments the anti-friction bearing arrangement preferably comprises at least one supporting rolling body which is rotatably mounted in the drive piston or in a bearing arrangement connected with it, such supporting rolling body being adapted to run along part of the cylinder wall opposite to the direction of the force acting on the drive piston.

The anti-friction bearing arrangement is preferably arranged between the two piston seal regions sealing off the drive piston on either side. In this respect it is possible for the anti-friction bearing arrangement to possess two regions which are connected together, on which one respective region of the two-part force transmission part is arranged. In this respect a respective piston sealing region of the drive piston is preferably arranged of the two terminal regions of the bearing arrangement for the anti-friction bearing arrangement so that a symmetrical modular arrangement is produced which may be assembled as desired at any time.

The at least one force transmission part connected with the drive piston may, in accordance with an advantageous form of the invention, be designed in the form of a suspension device for the load and extend vertically downward out of the longitudinal slot. In the case of such a design it is for instance possible for a curtain or a sliding wall or window to be suspended, which may then be pneumatically along a long distance.

In order to prevent a pivoting of the piston and undesired friction of the force transmission part in the longitudinal slot such force transmission part possesses a plain or anti-friction bearing guide for dealing with forces occurring on pivoting of the drive piston. Such guide is preferably arranged at the longitudinal slot.

Further advantageous developments and convenient forms of the invention will be understood from the following detailed descriptive disclosure of embodiments of the accompanying drawings.

LIST OF THE SEVERAL VIEWS OF THE FIGURES.

DETAILED ACCOUNT OF WORKING EMBODIMENTS OF THE INVENTION.

Figure 1:
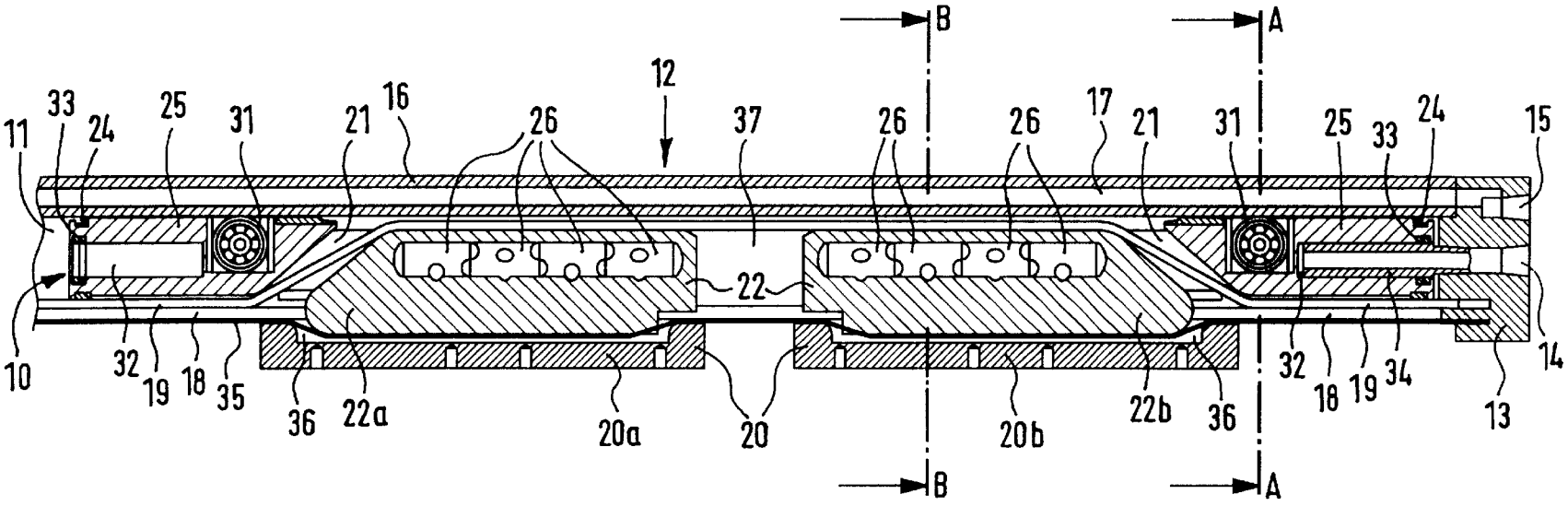
FIG. 1 shows a drive and guide means as a working example of the invention in longitudinal sectional representation.

In the case of the first embodiment of the invention represented in FIGS. 1 through 4 a rodless drive piston 10 is able to be pneumatically moved in a cylinder space 11, defined by the cylinder bore, of an elongated pressure medium power cylinder 12, hydraulic operation also being possible in principle as well. In FIG. 1 only the right hand end the region of the pressure medium cylinder 12 is represented and the drive piston 10 is located in the right abutment position on the right hand cylinder end plate 13.

A first pressure medium port 14 in the center region of the cylinder end plate 13 serves to move the drive piston 10 to the left (in terms of the representation of FIG. 1) and second pressure medium port 15 on the top region of the cylinder end plate 13 is connected via a pressure line 17, which extends in parallelism to the cylinder space 11 in the housing 16 of the pressure medium cylinder 12, with the second end region (not illustrated) of the cylinder space 11 and serves for moving the drive piston 10 in the opposite direction, that is to say to the right. This means that both pressure medium ports 14 and 15 can be arranged in the same cylinder end plate 13.

The pressure medium cylinder 12 is designed in the form of a so-called slotted cylinder, that is to say the cylinder space is connected with the outside around the pressure medium cylinder 12. For sealing purposes tape 19 is employed in a known manner, same being anchored in both cylinder end plates 13, it serving to seal off or obiturate the longitudinal slot 18 in relation to the cylinder space 11 axially on either side of a force transmission part 20, which is connected with the drive piston 10 and extends through the longitudinal slot 18 to the outside. At such force transmission part 20 the sealing tape 19 extends in asliding manner through guide channels 21 in the drive piston 10 and in part extends along the rear side opposite to the force transmission part 20 as is depicted in FIG. 1.

In the middle region the drive piston 10 possesses a two-part bearing arrangement 22 for rolling or anti-friction elements in the form of wheels 23 or rollers, forming the force transmission part 20, which is also made in two parts, being secured to the two-part bearing arrangement 22. On either side of the bearing arrangement 22 a piston sealing region 25 is present, which is respectively provided with a piston seal 24, that is to say the region 25 is connected with the force transmission part 20.

The wheels 23 are arranged in corresponding slot recesses 26 in the bearing arrangement 22. The eight wheels 23 in the working example are in accordance with FIGS. 3 and 4 slanted alternatingly by approximately 45° to the vertical in accordance with FIGS. 3 and 4 in opposite directions and are arranged in tandem in the longitudinal direction. The vertical direction is in FIG. 3 the same as the direction of the force exerted by the load, not indicated in detail acting on the drive piston 10, the pivoting of the wheels 23 always taking place in relation to the force direction so that the wheels 23 are supported symmetrically in relation to the force on the bore face defining the cylinder space 11. They extend respectively outward only from the slot recesses 26 on that side, at which the supporting action is required.

Figure 3:
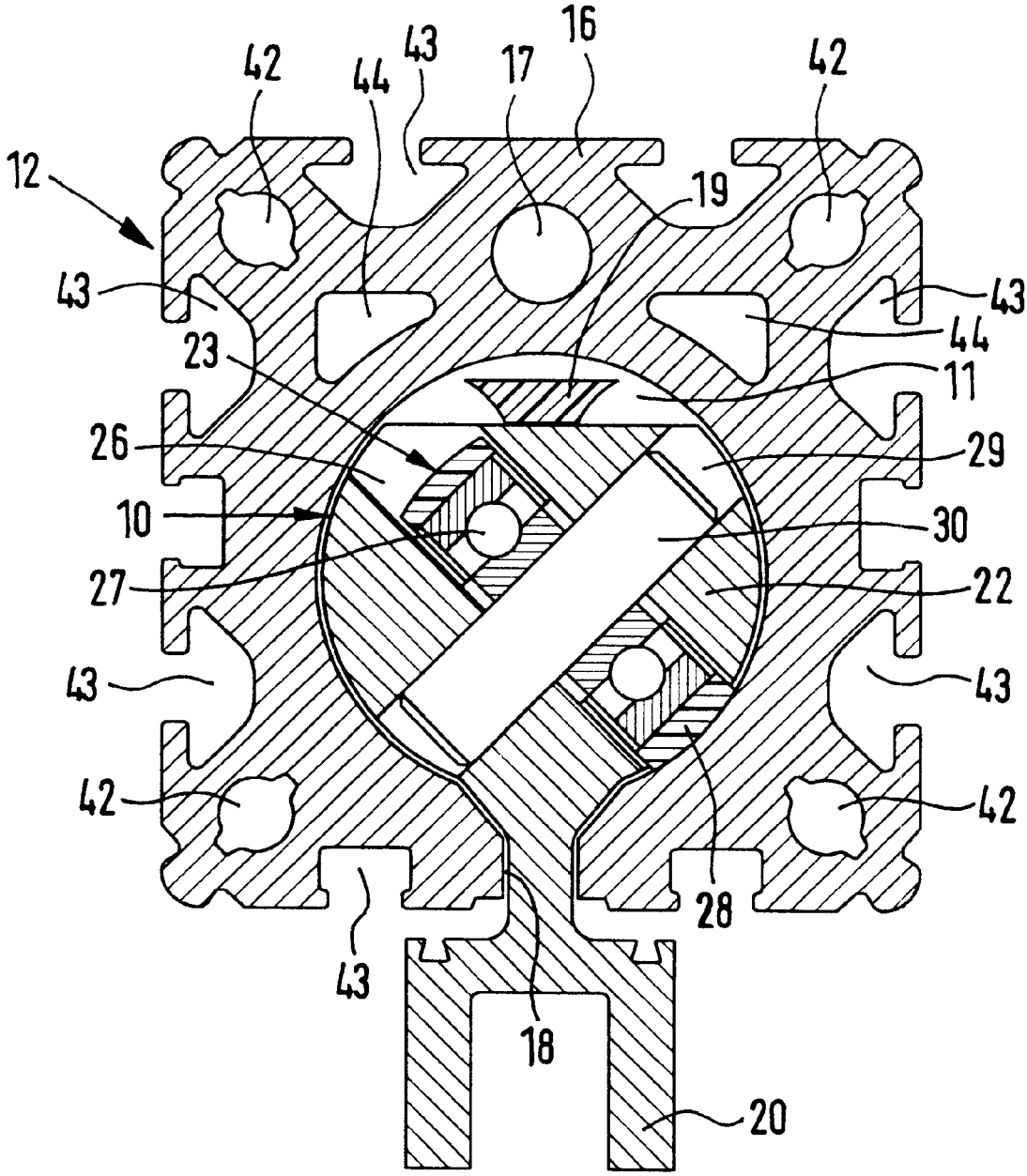
FIG. 3 shows a cross sectional view taken on the section line B—B of FIG. 1.

Each wheel possesses, see FIG. 3, an anti-friction or rolling element bearing 27 and peripherally is provided with a rubber-like or synthetic resin-like tire 28 in order not to damage the cylinder wall. The anti-friction bearings 27 are each mounted on a pin 30 in a transverse hole 29 athwart the slot recess 26.

In the two piston seal regions 25 there is a rotatably mounted support wheel 31, which is designed and mounted like the wheels 23 so that identical or functionally similar components are indicated by the same reference numerals. This support wheel 31 extends in a direction opposite to that of the force, i. e. in terms of the top of FIG. 2, away from the drive piston 10 or, respectively, the respective piston seal region 25 and resists any pivoting moments which may occur. Owing to such support wheels 31 the guidance of the drive piston 10 in the cylinder space 11 is improved. In principle the number of support wheels 31 may also be greater, an inclined arrangement also being possible. Furthermore it is possible to arrange such support wheels 31 at the bearing arrangement 32 as an alternative or in addition.

The two piston seal regions 25 respectively possess a blind hole 32 concentric to the free end, which hole is provided with a sealing ring 33. These blind holes 32 serve in a known fashion to damp in the terminal position.

When the drive piston 10 reaches one of its two end positions, shortly before a concentric, tubular damping member 34 mounted on the respective cylinder end plate 13 plunges into the blind hole 32. The air contained therein may escape through a choke means, not illustrated, with the result that there is damping effect.

The sealing tape 19 has the effect of closing the longitudinal slot from the inside, that is to say from the cylinder space 11 side. For this purpose it has a trapezoidal cross section, which is adapted to match the slot opening the directed toward cylinder space 11. In addition this longitudinal slot 18 is closed in a known manner by an external sealing tape 35 in order to prevent foreign matter finding its way into the interior. This external sealing tape 35 is fixed in the same fashion in the two cylinder end plates 13 and at the drive piston 10 is extended through suitable channels 36. In the illustrated working embodiment such external sealing tape 35 extends essentially between the bearing arrangement 22 and the force transmission part 20.

In accordance with FIG. 1 the bearing arrangement 2 comprises two regions 22*a* and 22*b* which are connected together by a connection member 37. Each of these regions 22*a* and 22*b* is connected with a region 20*a* and 20*b* of the two part force transmission part 20. If the load is very elongated in form, as for example a curtain, a door, a partition or the like, a very long connection member 37 can be provided so that the two regions 22*a* and 22*b* of the bearing arrangement 22 or, respectively, the two piston seal regions 25 may be far apart so that generally an extremely long "piston" is formed. On the contrary it is also possible to provide only a single bearing arrangement 22, which is provided on either side with a piston seal region 25. If an extremely elongated load is to be moved, then in such a case it is also possible to provide a plurality of such drive pistons, as for example two drive pistons 10.

Figure 4:
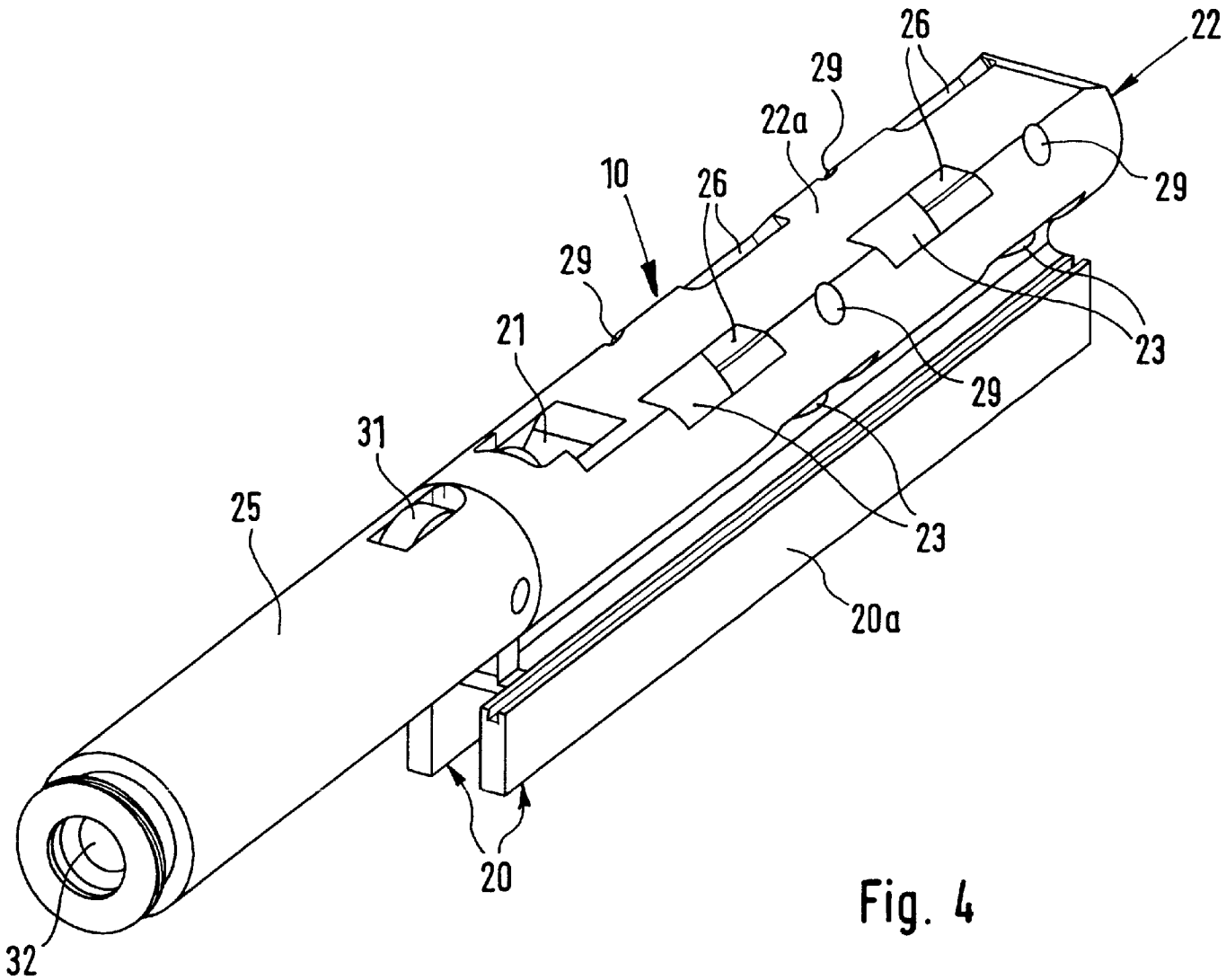
FIG. 4 shows a cross sectional representation in perspective of a region of the drive piston, consisting of two symmetrical parts, in accordance with FIG. 1.

FIG. 4 shows only one half of the drive piston 10 in perspective. In order to have an arrangement as in FIG. 1 two such halves are so joined together using the connection member 37 that the two piston seal regions 25 are directed outward. In the case of a single part or one piece design of the bearing arrangement 22 a second piston seal region 25 is added to the arrangement of FIG. 4.

The force transmission part 20 is designed for dependent suspension of a load. In order to prevent transverse friction forces and/or friction between the force transmission part 20 and the limiting wall of the longitudinal slot 18 it is possible to provide a plain or anti-friction bearing in this longitudinal slot or outside same, this not being illustrated in the drawing. It may also be necessary to have such bearing guide, when the direction of the force exerted by the load to be moved does not extend through the longitudinal slot 18.

Figure 5:
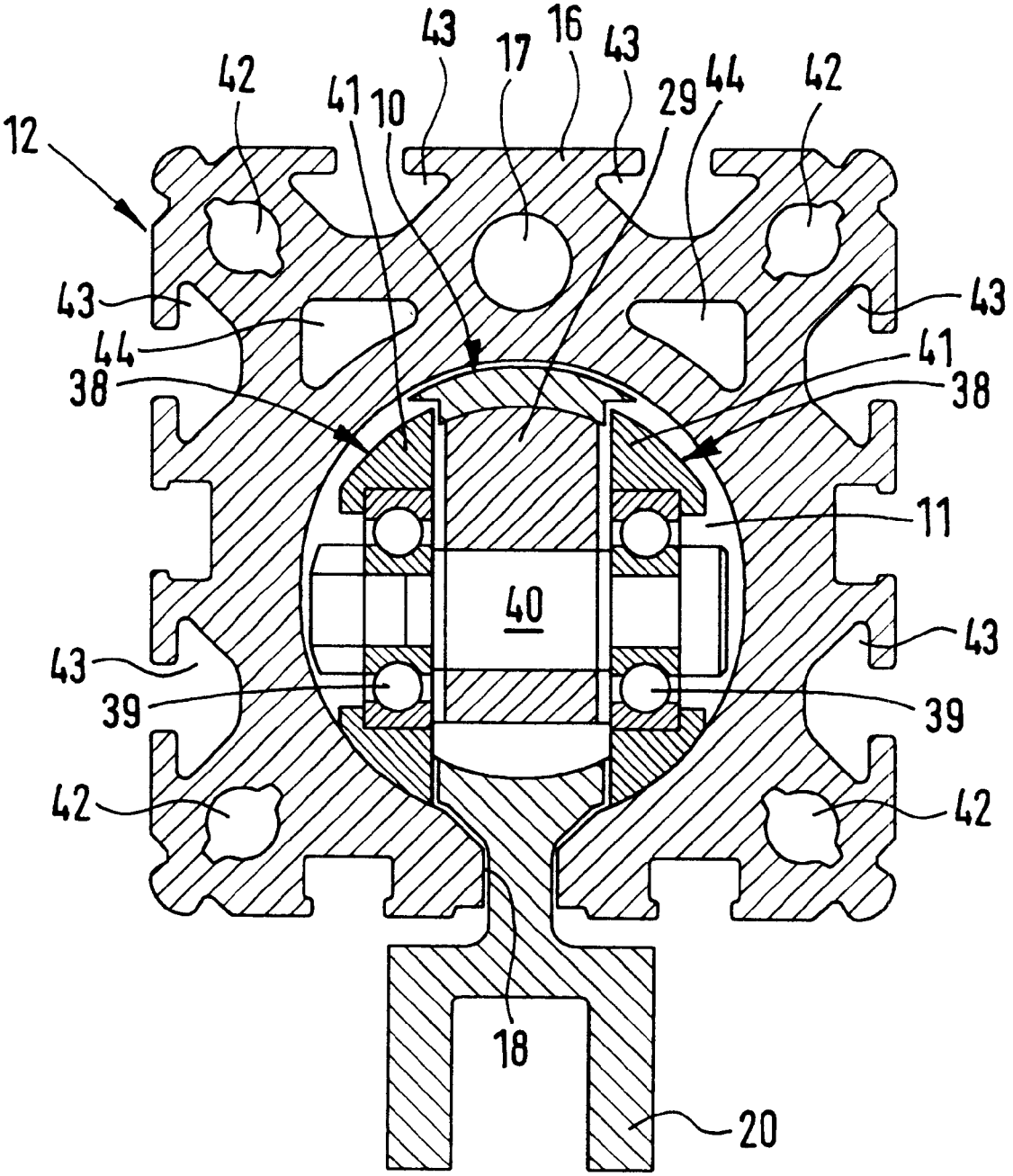
FIG. 5 shows an alternative design to that of FIG. 3 having parallel wheels on the drive piston.

In the case of second embodiment of FIG. 5 instead of the wheels 23 angularly offset from the force direction there are pairs of wheels 38, the wheels 38 being aligned in parallelism to the direction of the force, i. e. their axis of rotation extends in each case perpendicularly to the force direction and perpendicularly to the longitudinal direction of the cylinder. On a pin 40 mounted rotatably in a corresponding modified bearing arrangement 39 two such wheels 38 are rotatably mounted by means of anti-friction bearings 27. Several such pairs of wheels are arranged in tandem in the longitudinal direction of the cylinder. The running surfaces 41 of the wheels 38 are curved in accordance with the curvature of the cylinder space 11.

As modification of the illustrated embodiments of the invention it is possible, instead of wheel 23 and 38 to have other rolling elements, as for instance rollers or balls. Furthermore instead of the circular cross section of the drive piston 10 and the cylinder space 11 it is possible to have a different cross section, for instance an oval or polygonal cross section. Such piston cross sections lead to having a drive piston which can not be turned and if the load is not symmetrical the forces exerted on the cylinder bore may be taken up by this anti-friction bearing or rolling element.

Figure 2:
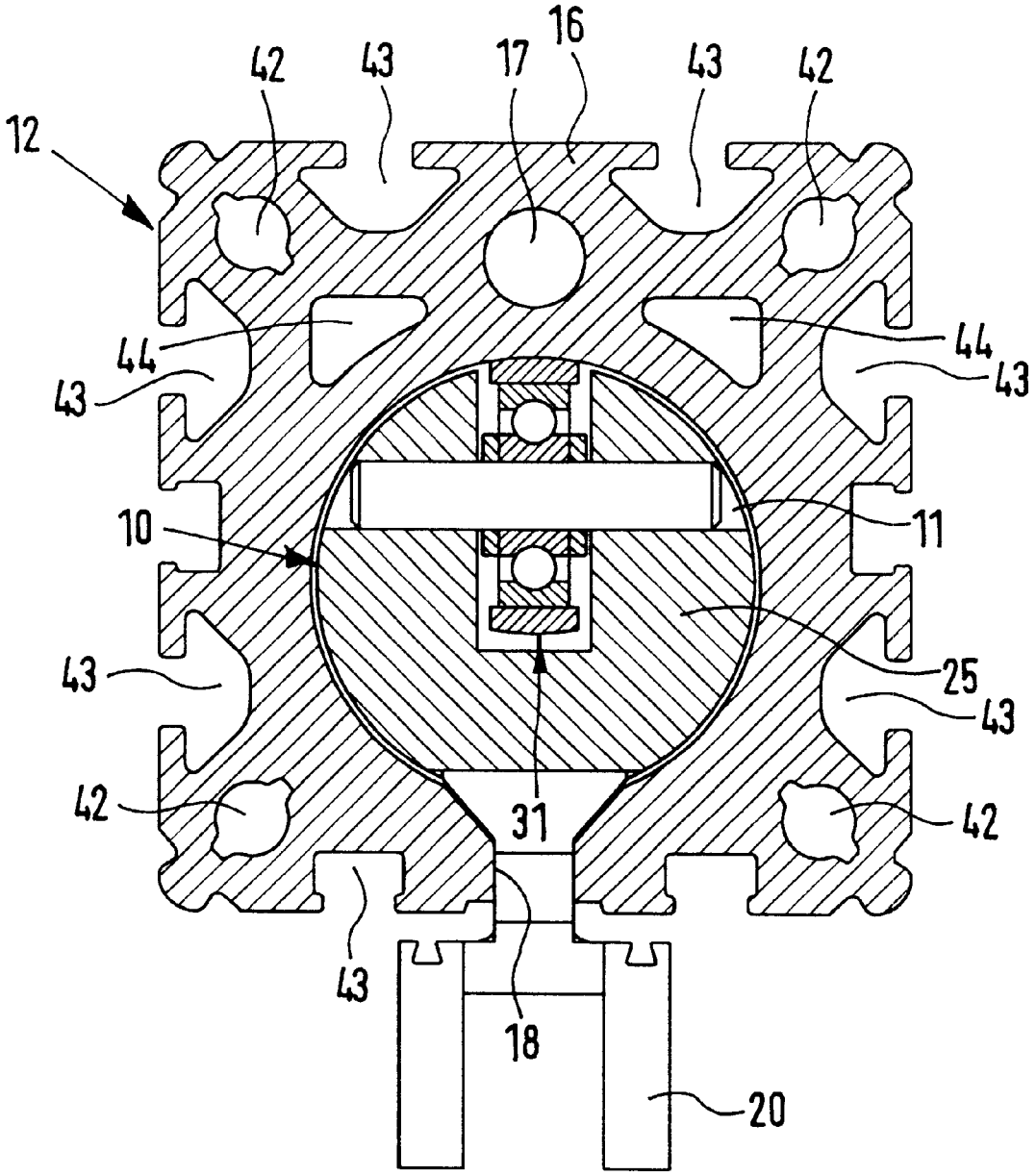
FIG. 2 shows a cross sectional view on the section line A—A of FIG. 1.

In accordance with FIGS. 2, 3 and 5 the housing 16 of the pressure medium cylinder 12 is provided with a attachment holes 42 and longitudinal slots 43. The attachment holes 42 serve for example for attachment of the cylinder end plates 13, whereas the longitudinal grooves 43 or slots serve for attachment of the pressure medium cylinder 12 itself and/or for attachment of sensor elements or the like. Additional longitudinal channels 44 may be provided to serve for the accommodation of electrical wiring or lines for pressure medium.

What is claimed is:

1. A drive and guide means for a load to be moved comprising a pressure medium cylinder, a rodless drive piston adapted to be driven by a pressure medium in such pressure medium cylinder, at least one force transmission part extending outward through a longitudinal slot in a wall of such cylinder, a flexible sealing tape for sealing off the longitudinal slot on either axial side of the force transmission part and an anti-friction bearing arrangement serving to take up a load and/or to guide the piston, such anti-friction bearing arrangement being arranged in the housing of the pressure medium cylinder, wherein the anti-friction bearing arrangement is arranged within the cylinder space of the pressure medium cylinder in or on the drive piston.

2. The drive and guide means as set forth in claim 1, wherein the anti-friction bearing comprises a plurality of wheels, rollers and/or balls adapted to run along the wall of the cylinder space.

3. The drive and guide means as set forth in claim 1, wherein the anti-friction bearing arrangement comprises several wheels or rollers inclined oppositely to the force acting on the piston, such wheels or rollers being arranged in tandem axially.

4. The drive and guide means as set forth in claim 3, wherein the wheels or rollers of the anti-friction bearing arrangement are set with an alternating slant.

5. The drive and guide means as set forth in claim 1, wherein the anti-friction bearing arrangement comprises several tandem arranged pairs of wheels or rollers, whose axes of rotation are perpendicular to the direction of motion of the drive piston and perpendicular to the direction of the force acting on the drive piston.

6. The drive and guide means as set forth in claim 3, wherein the anti-friction elements of the bearing arrangement are rotatably arranged in recesses in the drive piston or a bearing arrangement connected with same and project from such recesses at those points, at which the drive piston is thrust by the load against the wall of the cylinder space.

7. The drive and guide means as set forth in claim 1, wherein the anti-friction bearing arrangement comprises at least one support rolling element in the drive piston or in a bearing arrangement connected with same, such support rolling element being adapted to run on a position opposite to the direction of the force acting on the drive piston, on the wall of the cylinder space.

8. The drive and guide means as set forth in claim 1, wherein the anti-friction bearing arrangement is arranged between the two piston sealing regions sealing off the piston on either side thereof.

9. The drive and guide means as set forth in claim 8, wherein the anti-friction bearing arrangement comprises regions, which are joined together, of the bearing arrangement, on which in each case a region of the two-part force transmission part is arranged.

10. The drive and guide means as set forth in claim 8, wherein a respective sealing region of the drive piston is arranged at the two end regions of the bearing arrangement for the anti-friction bearing arrangement.

11. The drive and guide means as set forth in claim 1, wherein the at least one force transmission part connected with the drive piston is designed as a suspension device, connected with the drive piston, for the load and extends vertically downward out of the longitudinal slot.

12. The drive and guide means as set forth in claim 1, wherein the force transmission part comprises a plain or anti-friction bearing guide for resisting forces occurring on pivoting of the drive piston.

13. The drive and guide means as set forth in claim 12, wherein the plain or anti-friction bearing guide is arranged at the longitudinal slot.

14. A drive and guide for a load to be moved comprising:

a pressure medium cylinder;

a rodless drive piston adapted to be driven by a pressure medium within a cylinder space of the pressure medium cylinder;

at least one force transmission part extending outward through a longitudinal slot in a wall of said pressure medium cylinder;

an elongated flexible seal for sealing off the longitudinal slot on either axial side of the force transmission part; and an anti-friction bearing arrangement positioned within the cylinder space of the pressure medium cylinder and supported by the drive piston.

15. A drive and guide means as set forth in claim 1, wherein said rodless drive piston includes at least one sealing region having a sealing means positioned between said rodless drive piston and said pressure medium cylinder to create a seal therebetween.

* * * * *